US008414248B2

(12) United States Patent
Perez et al.

(10) Patent No.: US 8,414,248 B2
(45) Date of Patent: Apr. 9, 2013

(54) VARIABLE GEOMETRY VANE

(75) Inventors: Lucas R. Perez, Indianapolis, IN (US); Gary Steed, Avon, IN (US); Terry Penrod, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 677 days.

(21) Appl. No.: 12/630,757

(22) Filed: Dec. 3, 2009

(65) Prior Publication Data

US 2010/0166540 A1 Jul. 1, 2010

Related U.S. Application Data

(60) Provisional application No. 61/203,862, filed on Dec. 30, 2008.

(51) Int. Cl.
*F01D 5/10* (2006.01)

(52) U.S. Cl.
USPC ..... 415/1; 415/119; 415/160; 415/163; 415/191; 415/208.2

(58) Field of Classification Search ..... 415/119, 415/156, 159–166, 191, 208.2
See application file for complete search history.

(56) References Cited

U.S. PATENT DOCUMENTS 3,788,763 A * 1/1974 Nickles ..... 415/147
3,887,297 A 6/1975 Welchek
4,050,844 A 9/1977 Miller et al.
4,664,594 A 5/1987 Mandet et al.
4,668,165 A * 5/1987 Ludwick ..... 415/148
4,755,104 A 7/1988 Castro et al.
4,767,264 A * 8/1988 Kisling et al. ..... 415/156
4,808,069 A * 2/1989 Bonner et al. ..... 415/160
4,856,962 A 8/1989 McDow
4,979,874 A * 12/1990 Myers ..... 415/160
5,024,580 A * 6/1991 Olive ..... 415/150
5,380,152 A 1/1995 Sikorski et al.
5,700,129 A 12/1997 Kocian
6,019,574 A 2/2000 DeBella
6,113,349 A 9/2000 Bagepelli et al.
6,283,705 B1 9/2001 Rice et al.
6,315,519 B1 11/2001 Bagepalli et al.
6,699,010 B2 3/2004 Jinnai
6,799,945 B2 10/2004 Chatel
6,802,692 B2 * 10/2004 Bouru ..... 415/160
7,011,494 B2 3/2006 Kies et al.
7,104,754 B2 9/2006 Willshee et al.
7,112,040 B2 9/2006 Debeneix et al.
7,182,571 B2 * 2/2007 Selby ..... 415/156
7,448,848 B2 * 11/2008 Alexander et al. ..... 415/159
8,215,902 B2 * 7/2012 Major et al. ..... 415/161
2003/0143066 A1 7/2003 Bouru
2004/0146398 A1 7/2004 Bromann et al.
2004/0240990 A1 12/2004 Rockley
2006/0110246 A1 5/2006 Bruce
2006/0280597 A1 12/2006 Ochiai et al.

* cited by examiner

*Primary Examiner* — Igor Kershteyn
(74) *Attorney, Agent, or Firm* — Krieg DeVault LLP

(57) ABSTRACT

The present invention includes a pivotable vane having an airfoil with a vane spindle or stem extending toward a distal end thereof. The vane stem has a head with a pair of tapered flats having an outwardly extending angle as defined from the distal end of the head towards the airfoil. A vane arm having a substantially C-shaped connector with a pair of contact ends is constructed to maintain a gap with the tapered flats at an initial assembly step and positively engage the tapered flats at a final assembly step.

21 Claims, 5 Drawing Sheets

VARIABLE GEOMETRY VANE

CROSS REFERENCE TO RELATED APPLICATION

The present application claims the benefit of U.S. Provisional Patent Application 61/203,862 filed Dec. 30, 2008, and is incorporated herein by reference.

FIELD OF THE INVENTION

The present invention relates to a variable geometry vane and actuation system.

BACKGROUND

Variable geometry vanes are used in gas turbine engines and the like to produce a more efficient fluid flow through the turbo-machinery. Changing the pitch of the vane will change the velocity and pressure of the fluid entering the next rotating stage. If the vane cannot be accurately or precisely controlled, the efficiency of the machine cannot be maximized. One cause of inaccurate control is mechanical hysteresis. That is where the actual position of a mechanical component is partially a function of where the mechanical component was located prior to the previous movement. In other words the actual position of the component when moving the component from position one to position two may be different than when moving the component from position three to position two. This can be caused by variable positioning at component interfaces due to assembly variance or relative movement occurring between components during operation—sometimes called "mechanical play." The present invention provides a novel and non-obvious solution to problems associated with prior art vane actuation systems.

SUMMARY

The present invention includes a pivotable vane having an airfoil with a vane spindle or stem extending toward a distal end thereof. The vane stem has a head with a pair of tapered flats having an outwardly extending angle as defined from the distal end of the head towards the airfoil. A vane arm having a substantially C-shaped connector with a pair of contact ends is constructed to maintain a gap with the tapered flats at an initial assembly step and positively engage the tapered flats at a final assembly step. Further embodiments, forms, features, aspects, benefits, and advantages shall become apparent from the description and figures provided herewith.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
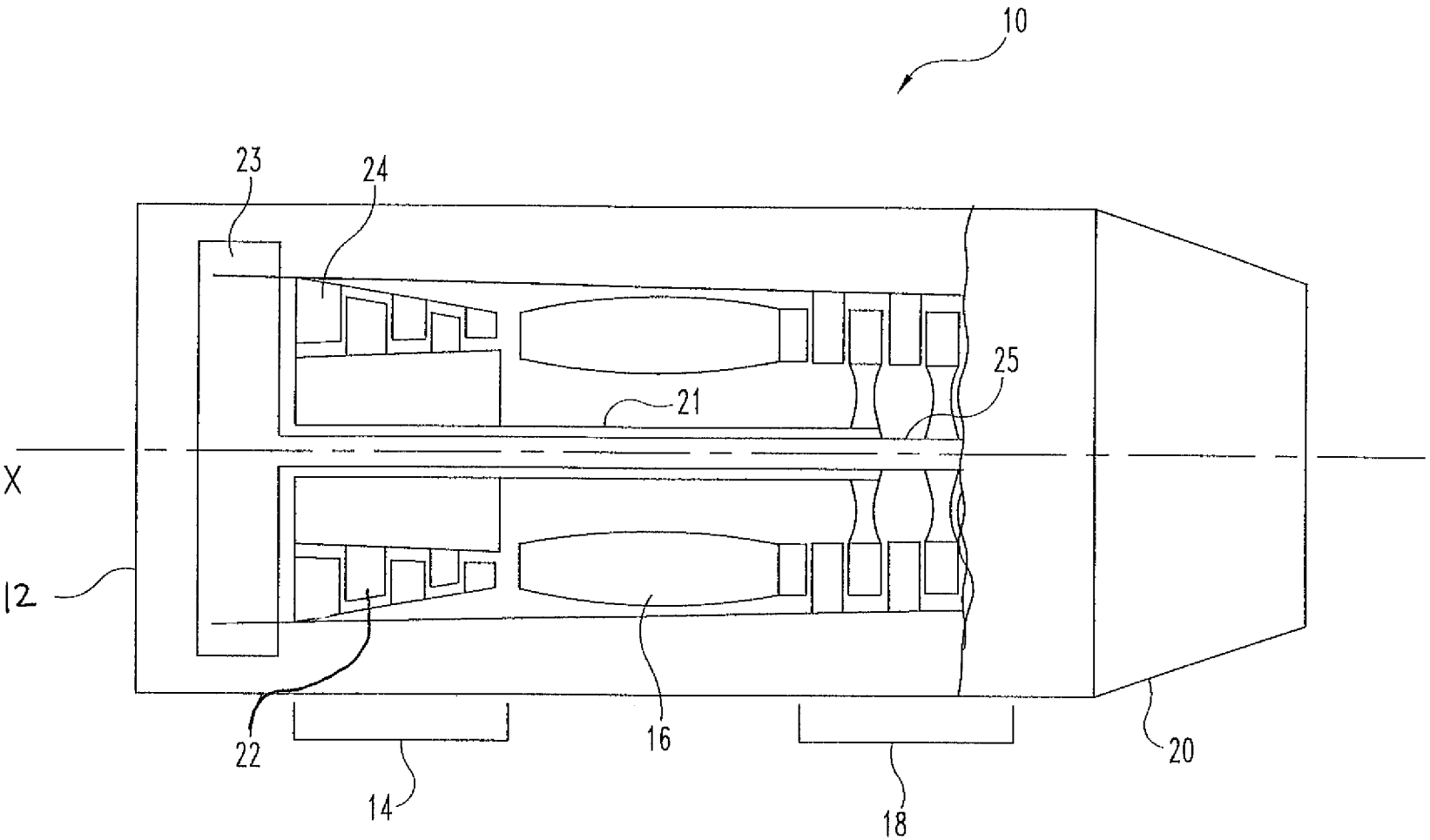
FIG. 1 is a schematic cross sectional view of a gas turbine engine.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, a schematic view of a gas turbine engine 10 is depicted. While the gas turbine engine is illustrated with two spools (i.e. two shafts connecting a turbine and a compressor and a fan), it should be understood that the present invention is not limited to any particular engine design or configuration and as such may be used in single or multi spool engines of the aero or power generation type. The gas turbine engine 10 will be described generally, however significant details regarding general gas turbine engines will not be presented herein as it is believed that the theory of operation and general parameters of gas turbine engines are well known to those of ordinary skill in the art. It should be further understood that while the variable geometry vane disclosure in the present application relates to relatively cold compression sections that the invention is also relevant in relatively hot flow sections having movable vanes such as in a turbine section.

The gas turbine engine 10 includes an inlet section 12, a compressor section 14, a combustor section 16, a turbine section 18, and an exhaust section 20. In operation, air is drawn in through the inlet 12 and compressed to a high pressure relative to ambient pressure in the compressor section 14. The air is mixed with fuel in the combustor section 16 wherein the fuel/air mixture burns and produces a high temperature and pressure working fluid from which the turbine section 18 extracts power. The turbine section 18 is mechanically coupled to the compressor section 14 via a shaft 21. The shaft 21 rotates about a centerline axis X that extends axially along the longitudinal axis of the engine 10, such that as the turbine section 18 rotates due to the forces generated by the high pressure working fluid the compressor section 14 is rotatingly driven by the turbine section 18 to produce compressed air. A portion of the power extracted from the turbine section 18 can be utilized to drive a second device 23 through a second shaft 25, such as a fan, an electrical generator, gas compressor or pump and the like.

The compression section 14 includes plurality of stages with rotating blades 22 that operate to compress working fluid and vanes 24 positioned upstream of a rotating blade 22 to control aerodynamic properties of the working fluid entering into the rotating stage. The compression section can include variable geometry such as pivotable vanes 24. Variable geometry vanes 24 increase the efficiency of the engine 10 by providing desired fluid conditions such as pressure and velocity to each stage of rotating blades 22 over a wide range of operating conditions.

Figure 2:
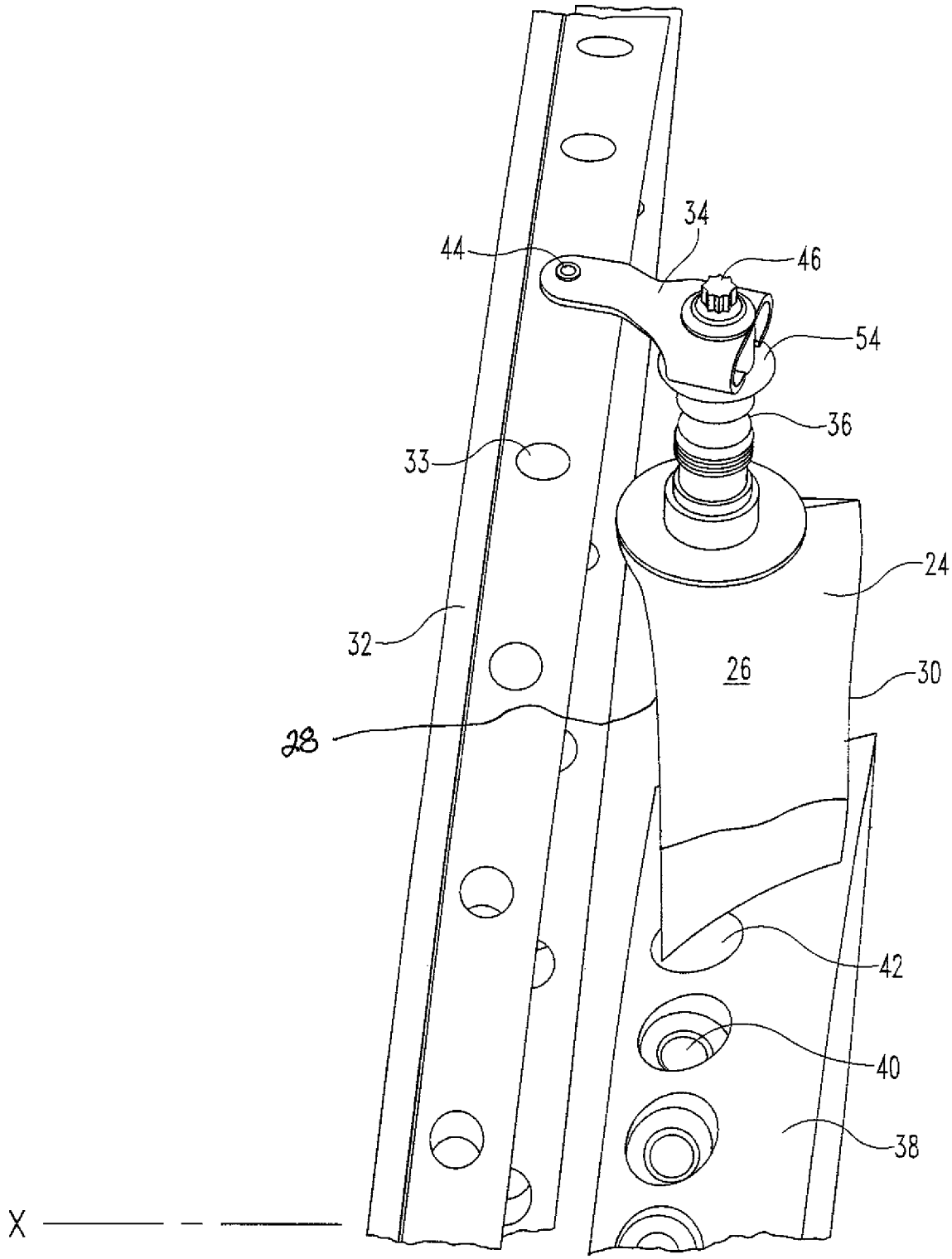
FIG. 2 is a view of a variable geometry vane and associated hardware.

Referring to FIG. 2, the pivotable vane 24 includes an airfoil 26 defined by a leading edge 28 and a trailing edge 30 shaped to control the aerodynamic properties of the working fluid as the working fluid passes across the vane 24. An actuator (not shown) of a hydraulic or electrical type known to those skilled in the art can be operably connected to actuation ring 32. The actuation ring 32 can be rotatingly pivoted about the axis of rotation X. The actuation ring 32 can include a connecting aperture 33 for a variable vane arm 34 to attach thereto. The vane 24 includes a vane spindle or stem 36 extending substantially radially outward from the tip of the airfoil 26 relative to the axis of rotation X. A connecting pin 44 pivotably connects the variable vane arm 34 to the actuation ring 32 and a fastener 46 fixedly connects the variable vane arm 34 to the vane spindle 36. In one form the fastener 46 is a threaded bolt, but other types of fasteners are also contemplated herein. A washer 54 can be disposed between the threaded fastener 46 and the variable vane arm 34 if desired.

An inner ring 38 is positioned radially inward of the vane 24 to provide pivotable support for the vane 24. The inner ring 38 is stationary relative to the axis of rotation X. The inner ring 38 can include a pivot socket 40 operable for receiving a pivot pin 42 connected adjacent the hub of the vane 24. The pivot socket 40 and the pivot pin 42 are formed concentrically to permit relative rotation between the pin 42 and the socket 40 while providing adequate radial and lateral support of the vane 24.

Figure 3:
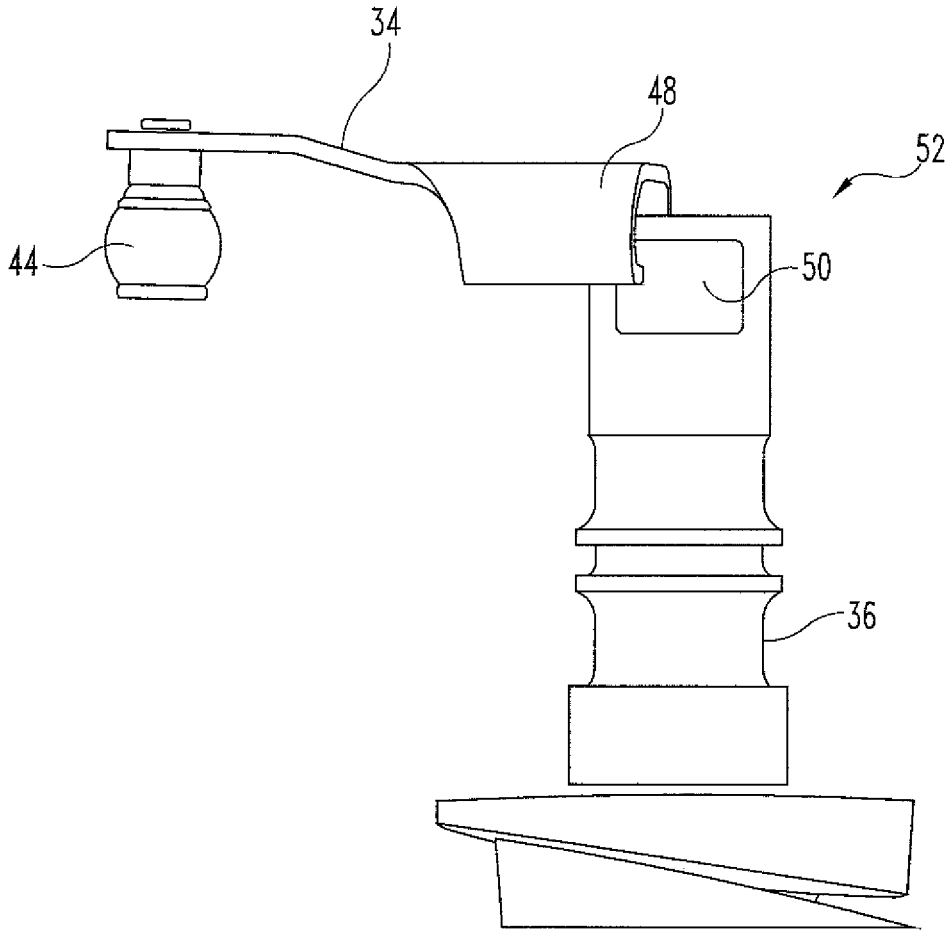
FIG. 3 is a side view of a variable vane arm partially engaged with a vane stem.

Referring to FIG. 3, a side view of the variable vane arm 34 and vane spindle 36 are shown partially assembled. In the illustrated embodiment the variable vane arm 34 includes a substantially C-shaped connector 48 that is engageable with a pair of tapered or angled flats 50, 52 formed adjacent one end of the spindle 36. Though the illustrated embodiment depicts two sides of the C-shaped connector 48 each having an extending portion that contacts the pair of tapered or angled flats 50, 52, other embodiments can have variations in the number or shape of the sides. Furthermore, the term "C-shaped" is not intended to be limited to shapes having a literal shape of a letter "C" but rather connotes a connector having an arm that includes a portion projecting toward a surface, such as the illustrated tapered or angled flats 50, 52, and having an end operable to contact the surface. The angled flats 50, 52 can have a substantially planar surface but in some embodiments can also include some variations in the surface such that a non-planar surface is provided.

Figure 4:
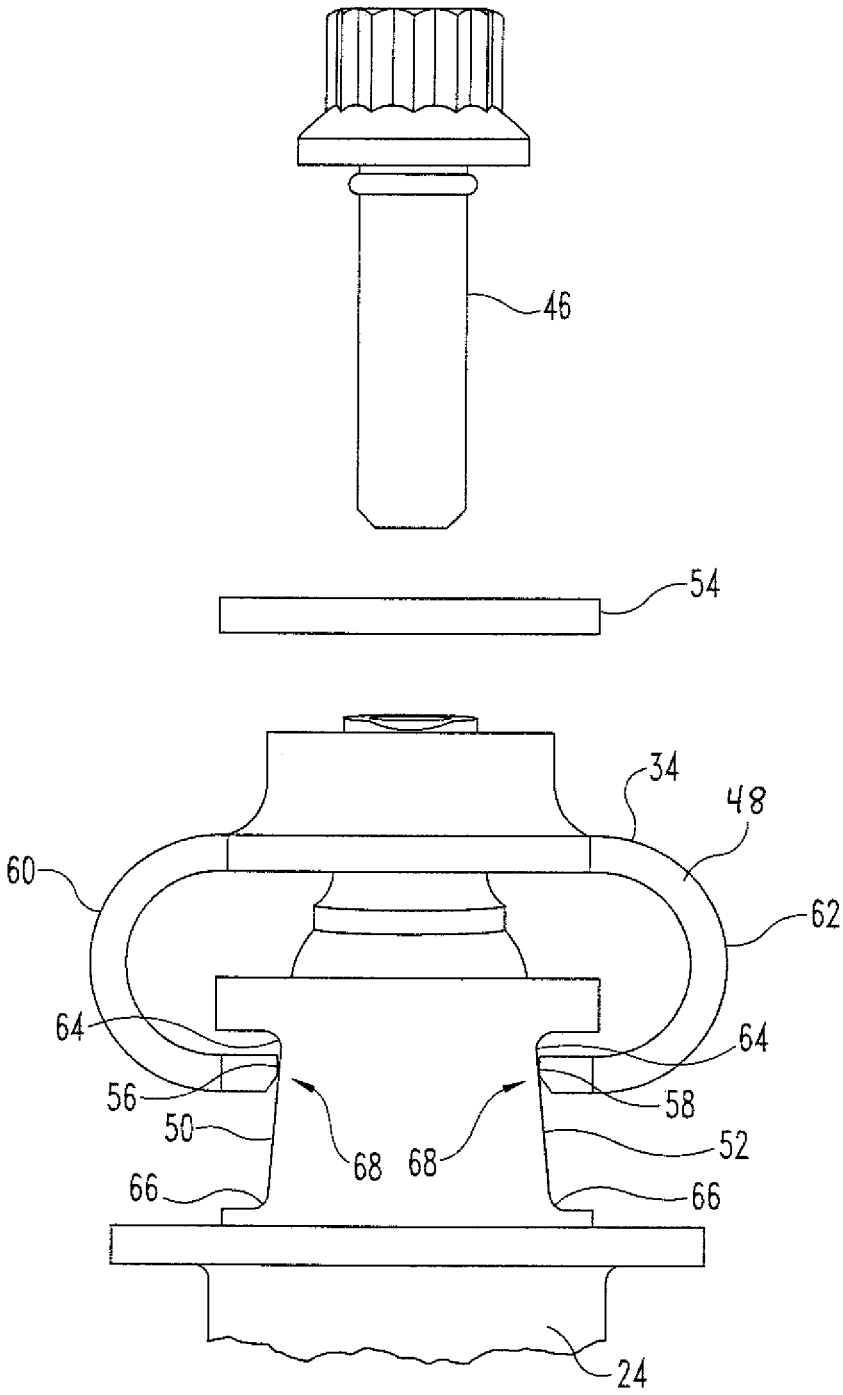
FIG. 4 is an exploded end view of the variable vane and vane stem of FIG. 3.
Figure 5:
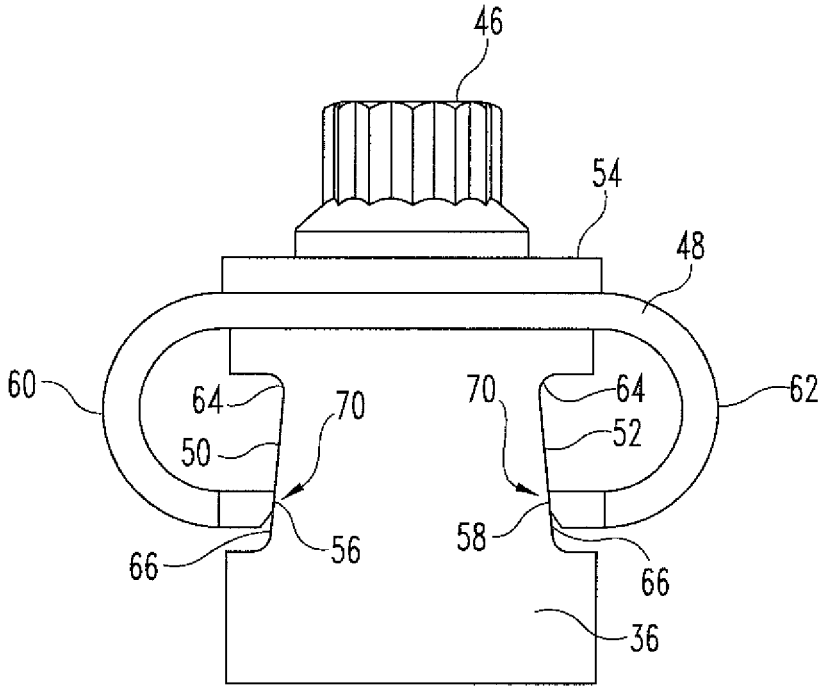
FIG. 5 is an assembled end view of the variable vane and vane stem of FIG. 4.

FIG. 4 shows the illustrated embodiment of the C-shaped connector 48 and the pair of angled flats 50, 52 more clearly. First and second ends 56, 58 of the C-shaped connector 48 are initially slid across an upper end 64 of the flats 50, 52 such that a gap 68 defined between the ends 56, 58 of the C-shaped connector 48 and the upper end 64 of the flats 50, 52 is maintained. The C-shaped connector 48 of the illustrated embodiment includes a first elbow 60 and a second elbow 62 connected to the first and second ends 56, 58 respectively. In one form the elbow 60, 62 can be relatively flexible in a radial direction relative to the x-axis and are relatively stiff in any other direction. The angled flats 50, 52 are sloped outward from the upper end 64 toward a lower end 66 of the head. As the C-shaped connector is installed the ends 56, 58 will move toward the lower end 66 of the angled flats 50, 52 until at least a portion of the gap 68 is eliminated and a press fit engagement 70 occurs as shown in FIG. 5. The fastener 46 locks the C-shaped connector 48 in place with the ends 56, 58 remaining in contact with angled flats 50, 52 due to the resiliency of the first and second elbows 60, 62 as each is flexed outward by the lower end 66 of the flats 50, 52.

One aspect of the present application provides an apparatus comprising a pivotable gas turbine engine vane having an airfoil with a vane stem extending toward a distal end, a head having a tapered surface formed adjacent the distal end of the vane stem, the tapered surface having an outwardly protruding angle extending from the distal end towards the airfoil, and a vane arm including a substantially C-shaped connector having a contact end constructed to maintain a gap with the tapered surface at an initial assembly step and positively engage the tapered surface at a final assembly step.

In one refinement the present application further includes a pair of contact ends.

In one refinement of the present application the pair of contact ends are an identical mirror image pair.

In one refinement the present application further includes a pair of tapered surfaces disposed on separate sides of the head.

In one refinement of the present application the separate sides are opposing sides of the head.

In one refinement of the present application the tapered surface is a substantially planar surface.

In one refinement the present application further includes a threaded connector operable to engage a threaded aperture in the vane arm, the threaded connector operable to urge the contact end to positively engage the tapered surface when the threaded connector is tightened.

In one refinement the present application further includes a load bearing surface disposed between an end of the connector and the head, the load bearing surface having an outside portion larger than an outside portion of the head.

In another aspect the present application provides an apparatus comprising a rotatable gas turbine engine vane, a unison ring operable to impart a rotation to the rotatable gas turbine engine device, and wherein the rotatable gas turbine engine vane is coupled to the unison ring when a contact portion of an extended arm is engaged with a contact surface of a coupling structure, the contact surface oriented at an angle relative to an axis along which the extended arm is urged toward the connector when coupling the extended arm to the coupling structure, the extended arm projecting toward the coupling structure having an angle different than the angle of the contact surface such that a non-contact area is created between the extended arm and the coupling structure when coupled.

In one refinement of the present application the contact surface is planar and the contact portion includes a face that substantially engages the contact surface.

In one refinement of the present application the contact portion is an end portion of the extended arm and includes a flat surface.

In one refinement of the present application the coupling structure is a spindle of the rotatable gas turbine engine vane.

In one refinement of the present application the extended arm is part of a structure having a C-shape that includes a second contact portion of a second extended arm.

In one refinement the present application further includes a washer and a fastener, the washer disposed between the fastener and the extended arm.

In one refinement of the present application the fastener includes a threaded surface that engages a complementary threaded surface, wherein the washer urges the extended arm along the axis as the fastener is turned and the threaded surface engages the complementary threaded surface.

In still another aspect the present application provides an apparatus comprising a gas turbine engine having a row of movable vanes, a unison ring operable to change an orientation of the movable vanes, and means for coupling the unison ring to at least one of the movable vanes.

In yet another aspect the present application provides a method comprising positioning a variable vane of a gas turbine engine in preparation for attachment to an arm operable to be coupled to a unison ring, urging a contact end of the arm into contact with a tapered surface of the variable vane, and wherein the urging includes flexing the arm and creating a coupling force that grips the contact end with the tapered surface.

In one refinement of the present application the engaging includes turning the fastener, the fastener having threads.

In one refinement of the present application the urging further includes engaging a portion of a flat surface of the contact end with the tapered surface of the variable vane.

In one refinement the present application further includes pressing an intermediate connection member against the arm with the fastener.

In one refinement the present application further includes engaging a fastener to secure the variable vane to the arm.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. An apparatus comprising:

a pivotable gas turbine engine vane having an airfoil with a vane stem extending toward a distal end;

a head having a tapered surface formed adjacent the distal end of the vane stem, the tapered surface having an outwardly protruding angle extending from the distal end towards the airfoil; and a vane arm including a substantially C-shaped connector having lateral sides that define the C-shaped connector and a contact end disposed at the end of the lateral sides of the C-shaped connector, wherein the vane arm is constructed to maintain a gap with the tapered surface at an initial assembly step and positively engage the tapered surface at a final assembly step while maintaining a gap between the lateral sides of the C-shaped connector and the tapered surface.

2. The apparatus of claim 1, which further includes a pair of contact ends.

3. The apparatus of claim 2, wherein the pair of contact ends are an identical mirror image pair.

4. The apparatus of claim 1, which further includes pair of tapered surfaces disposed on separate sides of the head.

5. The apparatus of claim 4, wherein the separate sides are opposing sides of the head.

6. The apparatus of claim 1, wherein the tapered surface is a substantially planar surface.

7. The apparatus of claim 1, which further includes a threaded connector operable to engage a threaded aperture in the vane arm, the threaded connector operable to urge the contact end to positively engage the tapered surface when the threaded connector is tightened.

8. The apparatus of claim 7, which further includes a load bearing surface disposed between an end of the connector and the head, the load bearing surface having an outside portion larger than an outside portion of the head.

9. An apparatus comprising:

a rotatable gas turbine engine vane;

a unison ring operable to impart a rotation to the rotatable gas turbine engine device; and wherein the rotatable gas turbine engine vane is coupled to the unison ring when a contact portion of an extended arm is engaged with a contact surface of a coupling structure, the contact surface oriented at an angle relative to an axis along which the extended arm is urged toward the coupling structure when coupling the extended arm to the coupling structure, the extended arm projecting toward the coupling structure having an angle different than the angle of the contact surface such that a non-contact area is created between the extended arm and the coupling structure when coupled.

10. The apparatus of claim 9, wherein the contact surface is planar and the contact portion includes a face that substantially engages the contact surface.

11. The apparatus of claim 10, wherein the contact portion is an end portion of the extended arm and includes a flat surface.

12. The apparatus of claim 10, wherein the coupling structure is a spindle of the rotatable gas turbine engine vane.

13. The apparatus of claim 9, wherein the extended arm is part of a structure having a C-shape that includes a second contact portion of a second extended arm.

14. The apparatus of claim 9, which further includes a washer and a fastener, the washer disposed between the fastener and the extended arm.

15. The apparatus of claim 14, wherein the fastener includes a threaded surface that engages a complementary threaded surface, wherein the washer urges the extended arm along the axis as the fastener is turned and the threaded surface engages the complementary threaded surface.

16. An apparatus comprising:

a gas turbine engine having a row of movable vanes;

a unison ring operable to change an orientation of the movable vanes; and means for coupling the unison ring to at least one of the movable vanes.

17. A method comprising:

positioning a variable vane of a gas turbine engine in preparation for attachment to a unison ring;

coupling the variable vane to the unison ring by:

urging a contact end of a coupling arm into contact with a tapered surface of a coupling structure; and wherein the urging includes flexing the coupling arm, creating a gripping force between the contact end and the tapered surface, and maintaining a gap between the coupling arm and the tapered surface.

18. The method of claim 17, wherein the urging further includes engaging a portion of a flat surface of the contact end with the tapered surface of the variable vane.

19. The method of claim 18, which further includes pressing an intermediate connection member against the arm with the fastener.

20. The method of claim 17, which further includes engaging a fastener to secure the variable vane to the arm.

21. The method of claim 20, wherein the engaging includes turning the fastener, the fastener having threads.

* * * * *